US008869550B2

(12) United States Patent
Krause et al.

(10) Patent No.: US 8,869,550 B2
(45) Date of Patent: Oct. 28, 2014

(54) ICE AND COLD WATER DISPENSING ASSEMBLY AND RELATED REFRIGERATION APPLIANCE

(75) Inventors: Andrew Reinhard Krause, La Grange, KY (US); Edward Philip Strauss, Louisville, KY (US)

(73) Assignee: General Electric Company, Schenectady, NY (US)

( * ) Notice: Subject to any disclaimer, the term of this patent is extended or adjusted under 35 U.S.C. 154(b) by 342 days.

(21) Appl. No.: 12/984,805

(22) Filed: Jan. 5, 2011

(65) Prior Publication Data

US 2012/0167596 A1 Jul. 5, 2012

(51) Int. Cl.

| | |
|---|---|
| ***A23G 9/00*** | (2006.01) |
| ***F25B 21/02*** | (2006.01) |
| ***F25C 5/18*** | (2006.01) |
| ***F25C 1/00*** | (2006.01) |
| ***B67D 7/80*** | (2010.01) |
| ***F25C 5/00*** | (2006.01) |
| ***F25B 21/04*** | (2006.01) |
| ***F25D 23/12*** | (2006.01) |
| *F25C 1/08* | (2006.01) |

(52) U.S. Cl.

CPC ..... *F25D 23/126* (2013.01); *F25C 5/005* (2013.01); *F25B 21/04* (2013.01); *F25C 1/08* (2013.01); *F25C 2700/04* (2013.01); *F25D 2323/122* (2013.01)

USPC ..... 62/343; 62/3.63; 62/344; 62/347; 222/146.6

(58) Field of Classification Search

USPC ..... 62/3.63, 344, 347, 354; 222/146.6

See application file for complete search history.

(56) References Cited

U.S. PATENT DOCUMENTS

| | | | | |
|---|---|---|---|---|
| 4,055,053 | A * | 10/1977 | Elfving et al. | 62/3.63 |
| 4,727,720 | A * | 3/1988 | Wernicki | 62/3.63 |
| 5,526,854 | A * | 6/1996 | Unger | 141/351 |
| 5,778,677 | A * | 7/1998 | Hung et al. | 62/3.63 |
| 6,082,130 | A * | 7/2000 | Pastryk et al. | 62/344 |
| 6,735,959 | B1 | 5/2004 | Najewicz | |
| 7,658,212 | B2 * | 2/2010 | Meuleners et al. | 141/82 |
| 7,681,406 | B2 * | 3/2010 | Cushman et al. | 62/72 |
| 2008/0148762 | A1 * | 6/2008 | Guarino et al. | 62/344 |
| 2009/0165467 | A1 * | 7/2009 | Kim et al. | 62/3.63 |
| 2009/0293501 | A1 * | 12/2009 | Kulkarni et al. | 62/3.63 |

FOREIGN PATENT DOCUMENTS

| | | | | |
|---|---|---|---|---|
| WO | WO 2009078562 | A1 * | 6/2009 | F25D 11/02 |
| WO | WO 2009131313 | A2 * | 10/2009 | F25C 1/08 |

* cited by examiner

*Primary Examiner* — Cassey D Bauer
*Assistant Examiner* — Elizabeth Martin
(74) *Attorney, Agent, or Firm* — Dority & Manning, P.A.

(57) ABSTRACT

An ice and cold water dispensing assembly for a refrigeration appliance includes a reservoir holding water having a water level and an ice maker for making ice cubes to be held within the water within the reservoir. A structure is provided on the reservoir allowing the reservoir to be removably attached to the refrigeration appliance. A handle and a spout are attached to the reservoir and are configured for allowing manual dispensing of ice cubes or water from the reservoir when the reservoir is removed from the refrigeration appliance. An ice dispenser and a water dispenser are provided in the refrigeration appliance for dispensing ice cubes or water respectively from the reservoir when the reservoir is attached to the refrigeration appliance. Related refrigeration devices are also disclosed.

14 Claims, 8 Drawing Sheets

ICE AND COLD WATER DISPENSING ASSEMBLY AND RELATED REFRIGERATION APPLIANCE

FIELD OF THE INVENTION

The subject matter disclosed herein relates generally to an ice and cold water dispensing assembly suitable for removable attachment to a refrigeration appliance and to a related refrigeration appliance having such a dispensing assembly.

BACKGROUND OF THE INVENTION

Various ice maker designs have been proposed for refrigeration appliances such as commercial or home refrigerators and/or freezers. In certain ice makers known as float ice makers, ice cubes are formed beneath the surface of chilled water. The water is generally maintained just above the freezing point and elements that are colder than the freezing point are employed to form ice cubes beneath the surface. When the ice is sufficiently formed for harvesting, it is floats upward to be removed from the chilled water for storage or dispensing.

The tank of chilled water in a float ice maker must therefore be attached to cooling elements of some sort that are in intimate contact with parts of the tank. This equipment can add complexity to a refrigeration appliance. If a user were to wish to remove the water tank for emptying in bulk, cleaning or servicing, however, the cooling elements could be exposed or become subject to damage. Further, with current designs, the locations at which such tanks may be placed within a refrigeration appliance are limited by such complexity and concerns. Accordingly, an improved and modular design for an ice and cold water dispenser would be welcome.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice and cold water dispensing assembly for a refrigeration appliance is disclosed including a reservoir holding water having a water level and an ice maker for making ice cubes to be held within the water within the reservoir. A structure is provided on the reservoir allowing the reservoir to be removably attached to the refrigeration appliance. A handle and a spout are attached to the reservoir and are configured for allowing manual dispensing of ice cubes or water from the reservoir when the reservoir is removed from the refrigeration appliance. An ice dispenser and a water dispenser are provided in the refrigeration appliance for dispensing ice cubes or water respectively from the reservoir when the reservoir is attached to the refrigeration appliance. Various options and modifications are possible.

According to certain other aspects of the disclosure, a refrigeration appliance is disclosed including a refrigeration cabinet and a reservoir removably attachable within the refrigeration cabinet holding water having a water level. An ice maker is provided within the refrigeration cabinet for making ice cubes to be held within the water within the reservoir. A handle and a spout are attached to the reservoir and are configured for allowing manual dispensing of ice cubes or water from the reservoir when the reservoir is removed from the refrigeration cabinet. An ice dispenser and a water dispenser are provided for dispensing ice cubes or water respectively from the reservoir when the reservoir is attached to the refrigeration cabinet. As above, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
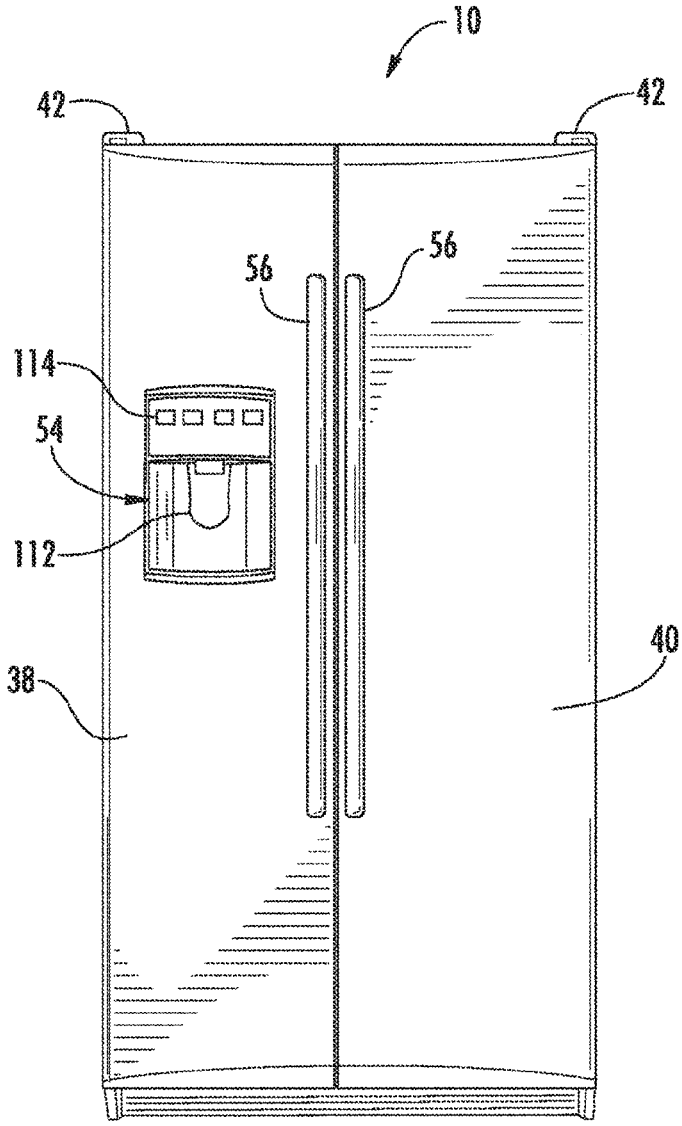
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a frontal view of an exemplary refrigeration appliance 10 depicted as a refrigerator in which dispenser target indicating assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. The present disclosure may be especially suitable for a compact refrigerator and/or freezer appliance where space is at a premium and an ice-making capability is desired. However, the disclosed ice-making assembly may be used with any such appliance.

Figure 2:
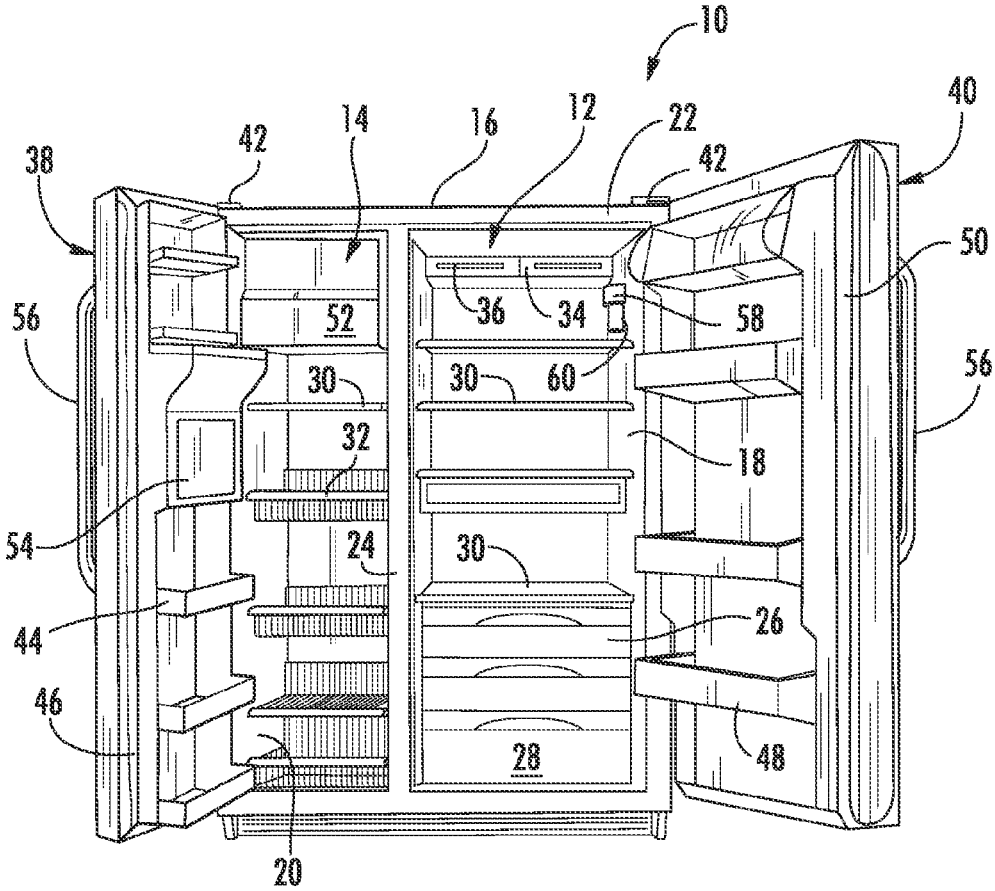
FIG. 2 provides a front view of the refrigeration appliance of FIG. 1 with its doors opened.

Referring to FIG. 2 the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

FIGS. 3-8 show various examples ice and cold water dispensing assemblies according to different aspects of the invention. Generally, the assemblies can dispense "soft ice" stored in a water bath near the freezing temperature to a user. Such soft ice is often desired by consumers as it is generally visibly clearer than and not as hard as ice maintained at a temperature well below the freezing point, as in some freezers. The dispensing assembly can include a reservoir removable from the refrigeration appliance for manual pouring of water or providing of ice, as well as for cleaning. If desired, the reservoir may be in the form of a pitcher. The reservoir may have portions of the ice maker connected to it (configured as a float ice maker for example) or may have the ice maker permanently attached to the refrigeration appliance.

Figure 3:
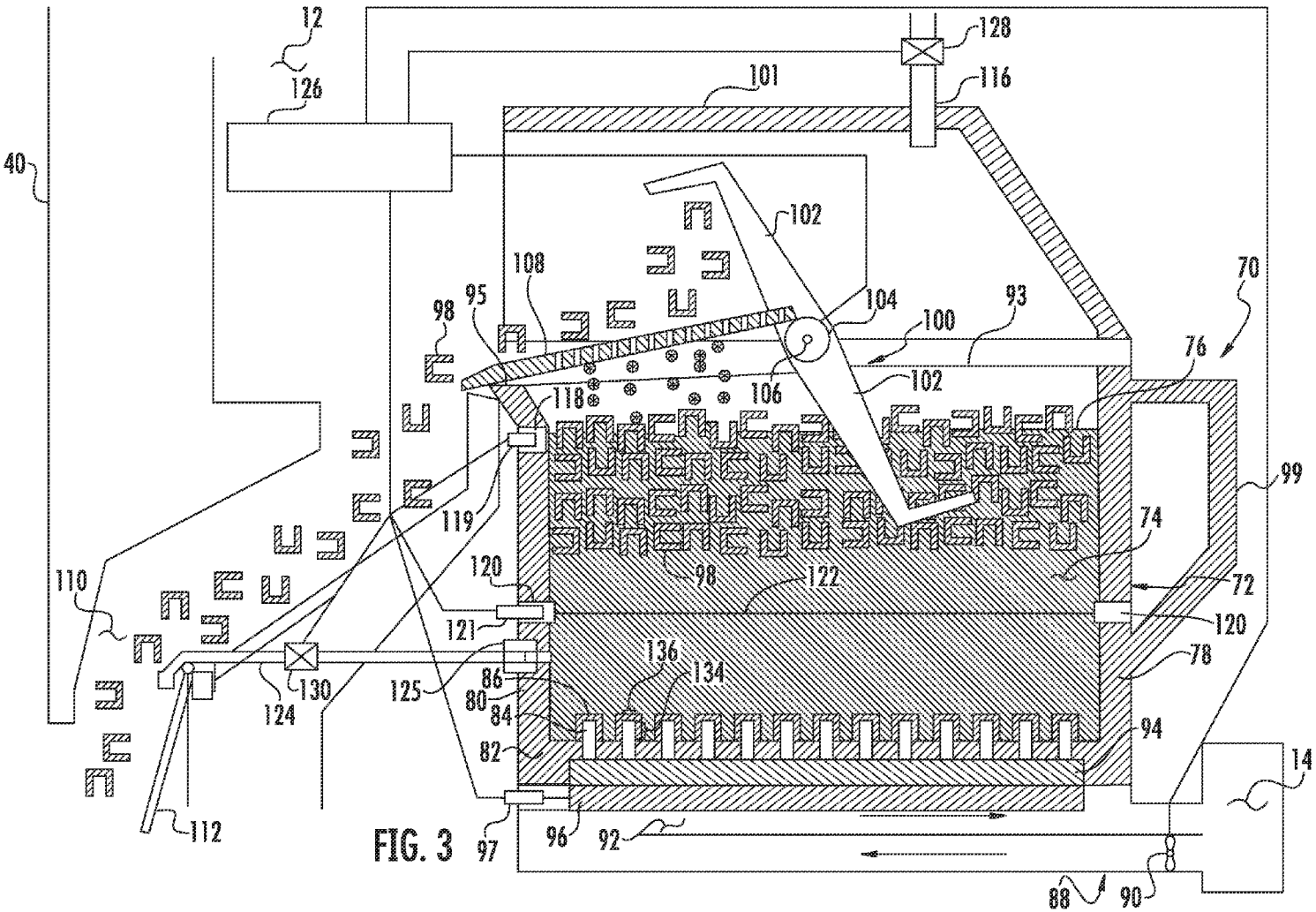
FIG. 3 provides a diagrammatical side view of an ice and cold water dispensing assembly according to certain aspects of the present disclosure mounted within a refrigerated compartment such as a refrigerator.

More particularly, as shown in FIG. 3, ice and cold water dispensing assembly 70 includes a reservoir 72 holding water 74 having a water level 76. Reservoir 72 has side walls 78,80 and a bottom wall 82. As shown, dispensing assembly 70 is mounted within fresh food storage (refrigerator) compartment 12 near door 40, but not mounted to the door so as to move with the door when it is opened.

At least one conductor 84 extends into reservoir 72 below water level 76. As shown, a row of such conductors 84 is visible along bottom wall 82. If desired, multiple rows could be provided in a grid format. Such conductors 84 could also or alternatively be located at other places within reservoir 72, such as along side walls 78,80, as long as the conductors are below water level 76. Conductors 84 may be rod-shaped, so as to form a cup-shaped ice cube 86, as discussed below.

A cooling device cools the conductors 84 to a temperature sufficient to form an ice cube on each of the conductors. As shown, cooling device comprises a Peltier device 96 (also known as a thermoelectric heat pump). Peltier device 96 may either be in contact with conductors 84 indirectly (via a heat transfer structure such as a metal heat transfer plate 94 known as a cold plate) or directly. Peltier devices are solid state devices that create a temperature gradient when attached to a source of DC voltage. The temperature gradient is reversible by reversing the polarity of the voltage. Therefore, with voltage provided in a first DC polarity, Peltier device 96 will cool conductors 84, and in a second DC polarity, it will heat conductors 84. A suitable Peltier device may be obtained from Kryotherm NA, of Carson City, Nev., although others could be employed. The capacity of the Peltier device would vary depending on the size and throughput desired for the ice maker.

If desired, a heat sink 88 may be provided. As shown, heat sink 88 may include a fan 90 blowing cold air from freezer storage compartment 14 along passageway 92 past Peltier device 96. Alternately, the cooling air flow could be sourced from outside of refrigeration appliance 10, refrigerator compartment 12, etc. Heat sink 88 could include another plate, fins, other structures, etc., as is known to enhance heat transfer from Peltier device 96. The design of heat sink 88 may vary depending on where (i.e., refrigerator or freezer compartment, refrigerator or freezer door, etc.) reservoir 72 is located.

Reservoir 72 may be cooled by cooling device 88 or an additional cooling device (not shown), or simply by virtue of its location within a refrigerated compartment or freezer, to a chilled temperature above the freezing point of water but not so far above that ice cubes melt rapidly in the reservoir. If reservoir 72 were mounted in a freezer, it might be necessary to heat the reservoir slightly to prevent all water 74 in it from freezing. Therefore, maintaining the water within reservoir 72 at a temperature no more than a few degrees above 32° F. would likely be acceptable.

Reservoir 72 is formed so as to be removable from refrigeration appliance 10 for manual dispensing of ice or water via open top 93 or spout 95. Peltier device 96 is attached to the bottom or reservoir 72 so as to be removable with the reservoir, connected to electronics via snap in quick connect elements 97 or the like. If desired, a curtain, flange or the like (not shown for clarity) can be provided around the bottom of reservoir 72 to shield Peltier device 96, connector 97, etc., when the reservoir is removed. Alternatively, Peltier device 96 could be mounted to the refrigeration appliance 10, appliance door 40, etc. A handle 99 may be provided on reservoir 72 for sliding the reservoir into or out of place and for pouring, etc. Reservoir 72 as shown is essentially in the shape of a pitcher which lends itself to such pouring.

When it is desired to harvest the ice cubes 86 from conductors 84, the polarity on Peltier device 96 can be reversed briefly, actively reversing the direction of heat transfer. Such reversal heats the side of Peltier device 96 facing conductors 84, thereby slightly melting ice cubes 86 on the conductors and allowing them to float upward to become ice cubes 98 ready for harvest. If desired, heat sink 88 can be shut off at this point. Alternatively, depending on the location of reservoir 72, Peltier device 96 and heat sink 88 can simply be shut off momentarily to allow slight melting. Other heating sources, such as warm refrigerant or warm air generated by the refrigerant cycle, could be also provided to supplement the function of Peltier device 96.

A dispensing device 100 attached to a wall 101 of the refrigeration cabinet 12 removes harvested ice cubes 98 from water 74. As shown, dispensing device 100 includes a scoop having at least one arm 102 driven by a motor 104 about an axle 106. Arms 102 scoop up formed ice cubes 98 from water 74 and deposit them on a separator 108 having drain openings therein sized to let water drip off scooped ice cubes back into reservoir 72 as ice cubes move toward a dispensing opening 110. Separator 108 may be formed as a plate, a grate, etc, and may be slanted downward toward dispensing opening 110 so that scooped ice cubes move toward the opening via gravity. A trigger, such as a mechanical paddle handle 112, a user input device such as a touch screen or a button 114 (see FIG. 1), or a combination of elements, could be manipulated by a user to cause the arm 102 to scoop ice cubes 98.

Accordingly, an ice cube 98 can be provided directly to a user as "soft ice" maintained in a cold water bath just above freezing, which is desired by many consumers. Alternatively, the ice cubes could be provided to a container such as an ice bucket maintained in a freezer compartment, either all the time or selectively via a movable diverter or the like (not shown). Thus, various options are possible for dispensing ice cubes formed in the reservoir.

If desired, a water source 116 and a water level sensor 118 may be provided. Water source 116 provides water to reservoir 72 when water level sensor 118 senses that the water level 76 is below a predetermined point. Also, an ice cube level sensor 120 such as an optical sensor can be provided for sensing a level 122 of ice cubes 98 in reservoir 72. Sensors 118 and 120 may be connected by slide in quick connect elements 119 and 121, respectively, when reservoir is placed in refrigeration cabinet 12. Peltier device 96 may be prevented from forming ice cubes 86 on conductor 84 when the ice cube level sensor 120 senses that the level of ice cubes 122 in reservoir 72 is above a predetermined amount.

If desired, a chilled water outlet 124 may be provided in communication with reservoir 72 for dispensing chilled water. A slide in quick connect liquid fitting 125 may be provided to place water outlet 124 in communication with water 74 inside of reservoir 72.

If desired, a dedicated controller 126 or controller 34 may be employed to control the various elements mentioned above. Valves 128 and 130 may be provided for water source 116 and outlet 124 as well.

Accordingly, during normal operation of ice making assembly 70, starting with a reservoir of water with no ice, the controller monitors signals from sensors 118 and 120, as well as user input devices 112 and 114, etc. If reservoir 72 is not full per sensor 118, controller causes valve 128 to open until sensor 118 detects that water level 76 has reached the sensor. If sensor 120 does not detect ice down to level 122, ice making commences by cooling conductors 84 via Peltier device 96, heat being transferred away by heat sink 88. Periodically, Peltier device 96 is reversed or shut off, as initiated by the controller, to free ice cubes 86 to float upward. This cycle continues until sensor 120 senses that the quantity of ice cubes 98 in reservoir 72 is sufficient to be sensed by sensor 120. At this point, cooling of conductors 84 stops until ice is removed or melts sufficiently that sensor 120 does not detect ice any longer. If a user wishes to receive ice cubes or water, input devices 112,114, etc are employed. Arm 102 is rotated by controller or valve 130 is operated to provide the desired substance (ice or water). After dispensing is completed, the controller evaluates signals from sensors 118 and 120 as to whether to add water to reservoir 72 and/or start or continue making ice cubes on conductors 84. As mentioned above, ice could be harvested by arm 102 and sent to an alternate location (such as an ice bucket in a freezer compartment) either upon user indication, periodically, or as a default if desired as an option.

Figure 6:
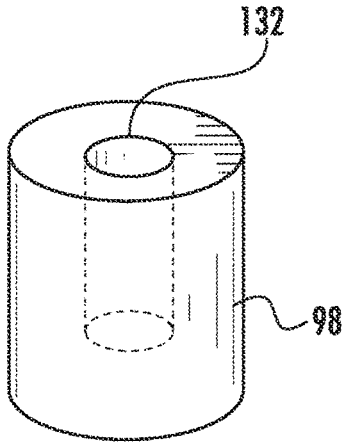
FIG. 6 provides a perspective of a cup-shaped ice cube that can be made using the assemblies of FIGS. 3-5.

Conductors 84 may be made in rod-shaped form so as to create a substantially cup-shaped ice cube (see ice 86 being formed in FIG. 3 and resultant ice cube 98 in FIG. 6.) The term "ice cube" as used herein therefore does not refer strictly to a cube of ice; rather it refers to an individual piece of ice. The pieces of ice formed by the device disclosed herein, if a rod-shaped conductor is used, are somewhat cup shaped. That is, ice cube 98 is substantially cylindrical with a smaller diameter hole 132 part of the way through, corresponding to the shape of the conductor 84. To form such an ice cube, conductors 84 may extend into reservoir 72 with a length 134 no more than three times its width 136. However, other conductor shapes could be employed, whether cylindrical with different ratios, or other shapes entirely.

Use of a Peltier device would most likely require a rectifier or the like to convert source AC electricity to DC for the rectifier, and switching to alternate the polarity. Such is well within the scope of ordinary skill in the art for a given voltage so not discussed here further. Use of a Peltier device may eliminate the need for electrical resistance strips (AC or DC) to heat conductors 84 for harvest.

Figure 4:
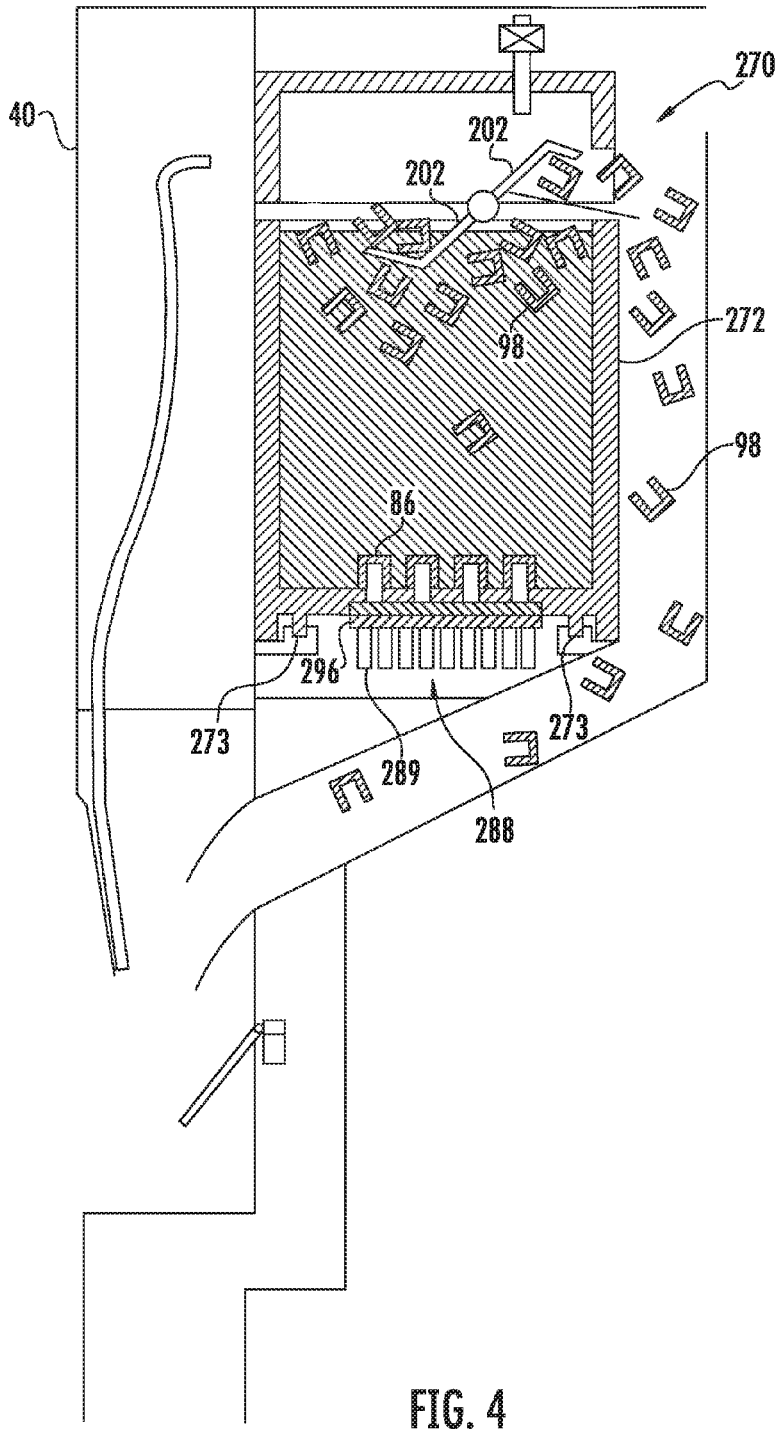
FIG. 4 provides a diagrammatical side view of an ice and cold water dispensing assembly according to certain other aspects of the present disclosure mounted within a refrigerated compartment door, such as a refrigerator door.
Figure 5:
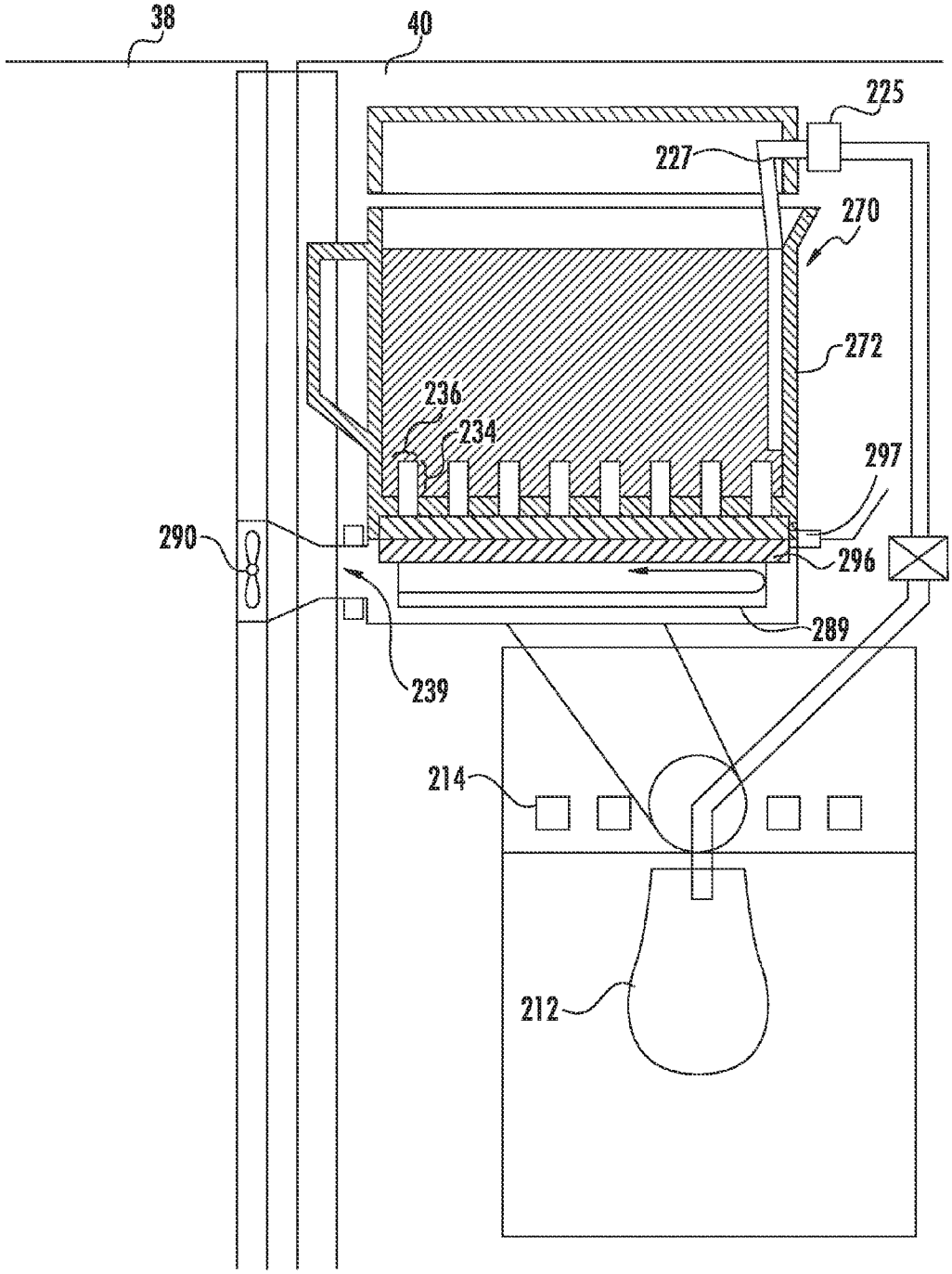
FIG. 5 provides a diagrammatical front view of the assembly according to FIG. 4.

FIGS. 4 and 5 show an alternate ice and cold water dispensing assembly 270 substantially similar to assembly 70, but located on refrigeration compartment door 40. Ice cubes 98 follow a path behind reservoir 272 after being scooped by arms 202. Peltier device 296 is provided to cool or heat reservoir 272 as above, and a heat sink 288 may be provided including a fan 290 to blow air from the freezer compartment though an openable passage 239 between doors 38,40. Fins 289 may be provided on Peltier device 296 to improve heat transfer. Input devices 212, 214 trigger the providing of chilled water or ice as above. Reservoir water outlet is in the form of a L-shaped tube 227 connecting a lower portion of reservoir 272 and liquid quick connect fitting 225 above reservoir 272. Ribs 273 extend from a base of reservoir 272 to allow sliding of the reservoir into place. Other than mounting of reservoir 272 in door 40 rather than in compartment 14, the structure and operation of ice making assembly 270 is substantially the same as ice making assembly 70 above.

Figure 7:
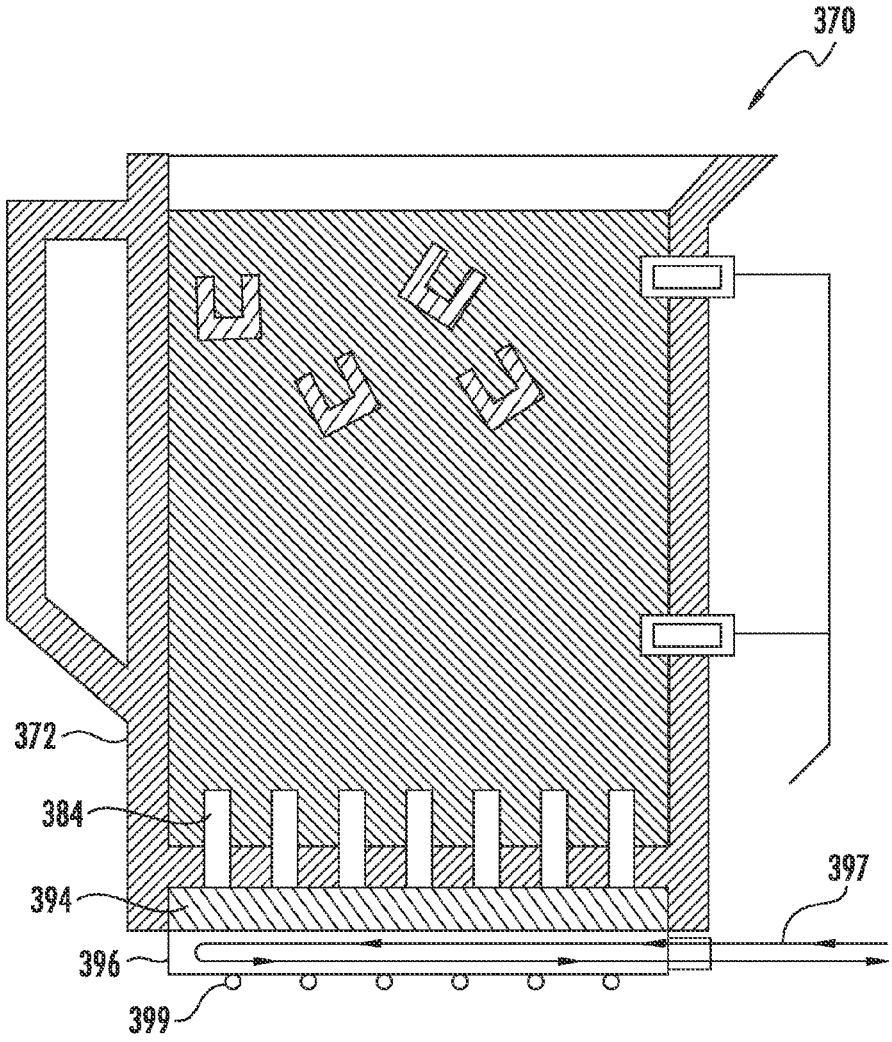
FIG. 7 provides a diagrammatical front view of an ice and cold water dispensing assembly according to certain other aspects of the present disclosure with an alternate float ice maker.

FIG. 7 shows a partial view of an alternate embodiment of a dispensing assembly 370 substantially similar to that or previous figures, except that reservoir 372 is cooled via an alternate structure. As shown therein, a cold plate 396 is provided beneath reservoir 372 for providing heat transfer to plate 394 and conductors 384. Cold plate 396 is cooled by refrigerant from the appliance refrigeration cycle, passing through loop 397 in plate 396. Electrical resistance heaters 399 are also provided. Therefore, when ice making is desired, refrigerant in loop 397 causes ice to form on conductors 384. When ice harvest is desired, loops can be turned off or fed warm refrigerant via valving (not shown). Also, electrical resistance heaters 399 can be turned on to warm conductors 384 enough to free ice cubes forming thereon. A scoop mechanism for removing ice cubes for dispensing can be provided but is not shown for clarity. Reservoir 372 is slidable out of refrigeration device 10 while cold plate 396 remains in place. Again, shielding (not shown) in the form of flanges, skirts, etc, can be provided to protect plate 394 when removed.

Figure 8:
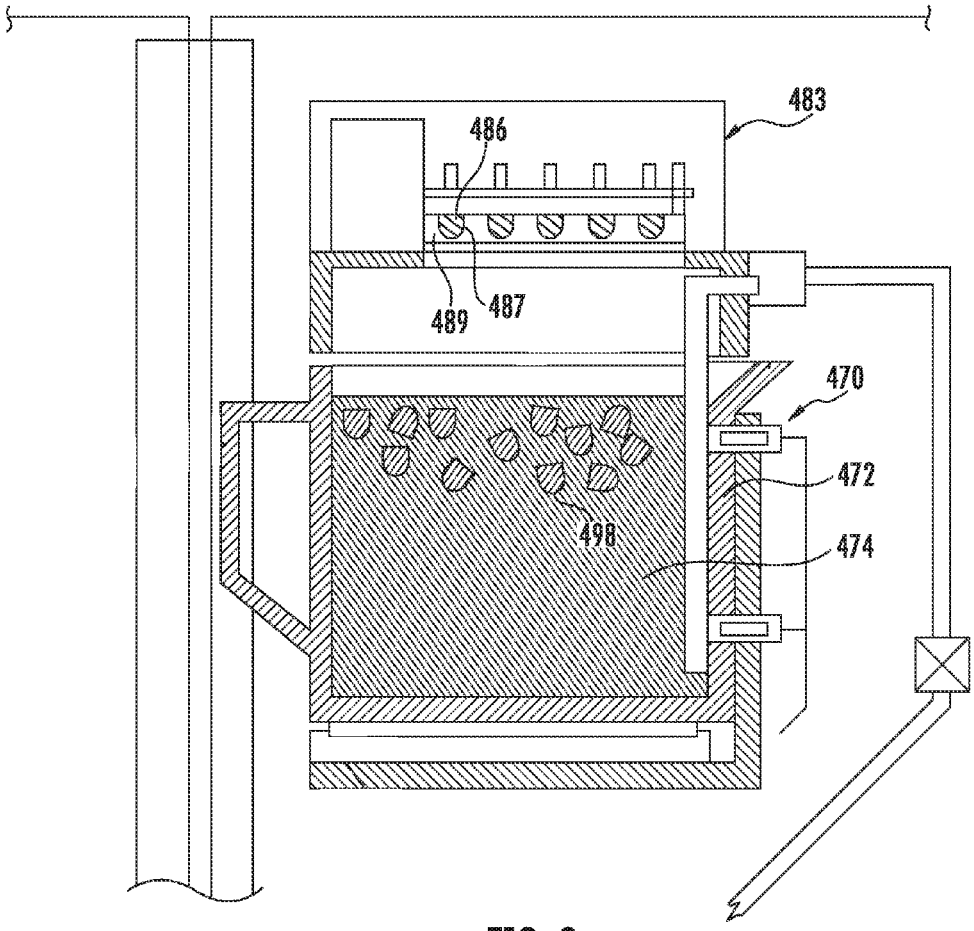
FIG. 8 provides a diagrammatical front view of an ice and cold water dispensing assembly according to certain other aspects of the present disclosure with a conventional ice maker mounted above a reservoir.

FIG. 8 shows another alternate embodiment of a dispensing assembly 470, in which reservoir 472 is mounted beneath a conventional ice maker 483 in which ice cubes 486 are formed in cavities 487 within mold 489. Ice maker 483 can be within a cooled compartment below the freezing temperature or can be directly cooled by a Peltier device, cold plate with a cooling loop, or any other method. Ice cubes 498 stored within water 474 are thus formed outside of reservoir 472 and dumped there. Assembly 470 therefore provides soft ice rather than ice held in a traditional ice bucket without water. Reservoir 472 is removable as above for manual dispensing of water or ice. As above a scoop mechanism (not shown) can be provided for dispensing ice cubes when desired.

Accordingly, the present disclosure provides a modular and efficient ice making assembly in which soft ice and/or cold water may be provided from a removable reservoir. The reservoir may be removed for cleaning or manual dispensing, and heating and cooling equipment for the ice making portion of the reservoir may be self contained and modular. A single solid state device may be employed to cool and to heat, and a heat sink may be included if desired. Use of a Peltier device with ice makers in this fashion allows for more choices as to types and location of the ice makers within various parts of a refrigeration appliance. However, other float type ice makers or conventional ice maker designs can also be used.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice and cold water dispensing assembly for a refrigeration appliance comprising:

a reservoir defining an interior volume, the interior volume of the reservoir configured for containing liquid water and ice cubes therein, the reservoir selectively attachable to the refrigeration appliance;

an inlet conduit having an outlet, the outlet of the inlet conduit positioned at the reservoir, the inlet conduit configured for directing the liquid water into the interior volume of the reservoir;

an ice maker configured for making the ice cubes and directing the ice cubes into the interior volume of the reservoir, the ice maker including at least one conductor and a heat transfer device, the at least one conductor attached to the reservoir and extending into the interior volume of the reservoir, the heat transfer device configured for selectively cooling the conductor to form the ice cubes thereon, the heat transfer device including a Peltier device that cools the conductor when current of a first polarity is applied and that heats the conductor to allow harvest of the ice cubes when current of a second polarity is applied, the Peltier device including electrical connectors connectable to electrical connectors in the refrigeration appliance when the reservoir is in the refrigeration appliance and disconnectable from the electrical connectors in the refrigeration appliance when the reservoir is to be removed from the refrigeration appliance;

a handle and a spout attached to the reservoir, the handle and the spout configured for allowing manual dispensing of the ice cubes and the liquid water from the interior volume of the reservoir when the reservoir is removed from the refrigeration appliance; and an ice dispenser and a water dispenser in the refrigeration appliance, the ice dispenser and water dispenser being in communication with the reservoir when the reservoir is attached to the refrigeration appliance, the ice dispenser configured for removing and dispensing the ice cubes from the interior volume of the reservoir and the water dispenser configured for removing and dispensing the liquid water from the interior volume of the reservoir when the reservoir is attached to the refrigeration appliance.

2. The dispensing assembly of claim 1, wherein the ice dispenser includes a scoop for removing the ice cubes from the liquid water in the interior volume of the reservoir, the scoop being rotatable about an axle with a motor, the scoop configured for lifting the ice cubes out of the interior volume of the reservoir during rotation of the scoop about the axle.

3. The dispensing assembly of claim 2, wherein the ice dispenser further includes a separator located above the interior volume of the reservoir, the scoop depositing the ice cubes from the interior volume of the reservoir onto the separator during rotation of the scoop about the axle, the separator sloping downwardly such that the separator directs the ice cubes away from the interior volume of the reservoir, the separator also defining openings, the openings being sized to allow the liquid water on the separator to pass therethrough back into the interior volume of the reservoir.

4. The dispensing assembly of claim 1, wherein a cold plate is provided between the Peltier device and the reservoir for heat transfer therebetween in either direction.

5. The dispensing assembly of claim 1, further including a heat sink for transferring heat away from the Peltier device.

6. A refrigeration appliance comprising:

a refrigeration cabinet;

a reservoir removably attachable within the refrigeration cabinet, the reservoir defining an interior volume, the interior volume of the reservoir configured for holding ice cubes and liquid water having a water level therein;

an inlet conduit having an outlet, the outlet of the inlet conduit positioned at the reservoir, the inlet conduit configured for directing the liquid water into the interior volume of the reservoir;

an ice maker positioned within the refrigeration cabinet, the ice maker configured for making the ice cubes, the ice maker also configured for depositing the ice cubes into the interior volume of the reservoir, the ice maker including at least one conductor and a heat transfer device, the at least one conductor attached to the reservoir and extending into the interior volume of the reservoir below the water level, and a heat transfer device for selectively cooling the conductor to form the ice cubes thereon, the heat transfer device including a Peltier device that cools the conductor when current of a first polarity is applied and that heats the conductor to allow harvest of the ice cubes when current of a second polarity is applied, the Peltier device including electrical connectors connectable to electrical connectors in the refrigeration appliance when the reservoir is in the refrigeration appliance and disconnectable from the electrical connectors in the refrigeration appliance when the reservoir is to be removed from the refrigeration appliance;

a handle and a spout attached to the reservoir, the handle and the spout configured for allowing manual dispensing of the ice cubes and the liquid water from the interior volume of the reservoir when the reservoir is removed from the refrigeration cabinet; and an ice dispenser and a water dispenser in communication with the reservoir when the reservoir is attached to the refrigeration cabinet, the ice dispenser configured for removing and dispensing the ice cubes from the interior volume of the reservoir and the water dispenser configured for removing and dispensing the liquid water from the interior volume of the reservoir when the reservoir is attached to the refrigeration cabinet.

7. The refrigeration appliance of claim 6, further including a water source and a water level sensor, the water source providing the liquid water to the interior volume of the reservoir through the inlet conduit when the water level sensor senses that the water level of the liquid water is below a predetermined point.

8. The refrigeration appliance of claim 6, further including an ice cube level sensor, the ice cube level sensor configured for sensing a level of the ice cubes in the interior volume of the reservoir, the ice maker being prevented from making the ice cubes when the ice cube level sensor senses that the level of the ice cubes in the interior volume of the reservoir is above a predetermined amount.

9. The refrigeration appliance of claim 6 wherein the ice dispenser includes a scoop for removing the ice cubes from the liquid water in the interior volume of the reservoir, the scoop being rotatable about an axle with a motor, the scoop configured for lifting the ice cubes out of the interior volume of the reservoir during rotation of the scoop about the axle.

10. The refrigeration appliance of claim 9, wherein the ice dispenser further includes a separator located above the interior volume of the reservoir, the scoop depositing the ice cubes from the interior volume of the reservoir onto the separator during rotation of the scoop about the axle, the separator sloping downwardly such that the separator directs the ice cubes away from the interior volume of the reservoir, the separator also defining openings, the openings being sized to allow the liquid water on the separator to pass therethrough back into the interior volume of the reservoir.

11. The refrigeration appliance of claim 6, further including a heat sink for transferring heat away from the Peltier device.

12. The refrigeration appliance of claim 6, wherein the heat transfer device includes a cold plate mounted in the refrigeration appliance and directly-cooled by a refrigerant.

13. The refrigeration appliance of claim 12, wherein the ice maker further includes an electrical resistance heater for heating the conductor in order to harvest the ice cubes.

14. The refrigeration appliance of claim 6, wherein the ice maker is mounted within the refrigeration appliance such that the ice maker is spaced apart from the reservoir.

* * * * *